US005373953A

United States Patent [19]

Fenton et al.

[11] Patent Number: 5,373,953

[45] Date of Patent: Dec. 20, 1994

[54] DISPLAY MOUNTING CAP FOR CONTAINERS

[76] Inventors: Russell R. Fenton, 48 Plantation Ct., East Amherst, N.Y. 14051; Elmer H. Goss, Jr., 4339 Chestnut Ridge, Apt. #6, Amherst, N.Y. 14228

[21] Appl. No.: 197,962

[22] Filed: Feb. 17, 1994

[51] Int. Cl.[5] ..... B65D 51/00

[52] U.S. Cl. ..... 215/228; 215/100 A; 220/212.5; 220/751; 206/806

[58] Field of Search ..... 220/212, 212.5, 751; 215/227, 228, 100 A, 100 R; 206/806

[56] References Cited

U.S. PATENT DOCUMENTS 2,763,377 9/1956 Martin .
3,180,528 4/1965 Balint et al. ..... 206/806 X
3,240,384 3/1966 Lermer .
3,300,075 1/1967 Dahl .
4,019,638 4/1977 Miller .
4,043,762 8/1977 Olds ..... 23/292

*Primary Examiner*—Gary E. Elkins
*Assistant Examiner*—Nova Stucker
*Attorney, Agent, or Firm*—Harpman & Harpman

[57] ABSTRACT

A display screw cap for containers providing a supporting configuration formed out of and integral with a top perimeter flange portion extending from the screw cap. The supporting configuration comprises multiple oppositely disposed aligned contoured apertures within the flange portion adapted to receive projecting support elements such as display pins, pegs, rods, hooks or the like through respective aligned pairs of contoured apertures.

5 Claims, 2 Drawing Sheets

DISPLAY MOUNTING CAP FOR CONTAINERS

BACKGROUND OF THE INVENTION

1. Technical Field

This device relates to closures for containers or the like that are used to provide a mounting opening for positioning on display units having multiple product support elements extending therefrom such as pegs, rods or hooks to provide vertical suspension and display of products positioned thereon. This display and storing fixture allow for the display of a variety of small objects that are usually packed in display packs or cards having mounting apertures within.

2. Description of Prior Art

Prior art devices of this type have relied on a variety of different cap and closure configurations to provide support for containers to be suspended from a display surface, see for example U.S. Pat. Nos. 2,763,377, 3,240,384, 3,300,075 and 4,019,638.

In U.S. Pat. No. 2,763,377 a jar support is disclosed having a support band engageable around the neck of a container with a hinged lid and mounting leg extending from the band. The leg is engageable into a rack configuration for support and display.

Pat. No. 3,240,384 is directed to a detachable cap having an integral support apertured upstanding tab that is slotted for bi-lateral deflection for placement and removal of the cap on a container from an adjacent mounting rod.

U.S. Pat. No. 3,300,075 is directed to a support closure for a container in which a closure is shown having an upwardly projecting tab integrally connected with the closure defined by a contoured transverse opening in the closure above the closure's top horizontal plane.

A hanging jar cap is shown in U.S. Pat. No. 4,019,638 wherein the cap has an upstanding triangular shaped tab extending therefrom. The tab is apertured triangularly defining a hook engagement surface within said tab.

Prior art also discloses several design patents directed to closures having mounting configurations integral therewith, see for example U.S. design Patents No. 282,053 on a closure hook combination in which the tab extends from the cap body which has a return defining a hook. In U.S. design Pat. No. 313,043 a closure is disclosed wherein an elongated tapered tab extends vertically from a cap body having an angularly disposed slot within forming a support engagement area and U.S. design Pat. No. 200,447 discloses a cap configuration hereinbefore described in U.S. utility Pat. No. 3,240,384 by the same inventor.

SUMMARY OF THE INVENTION

A display cap for containers having an enlarged upstanding perimeter flange extending therefrom with multiple contoured apertures formed within the flange in oppositely disposed pairs to provide for select receiving of projecting support elements from a vertical display or like surface.

DESCRIPTION OF THE PREFERRED EMBODIMENT

Figure 1:
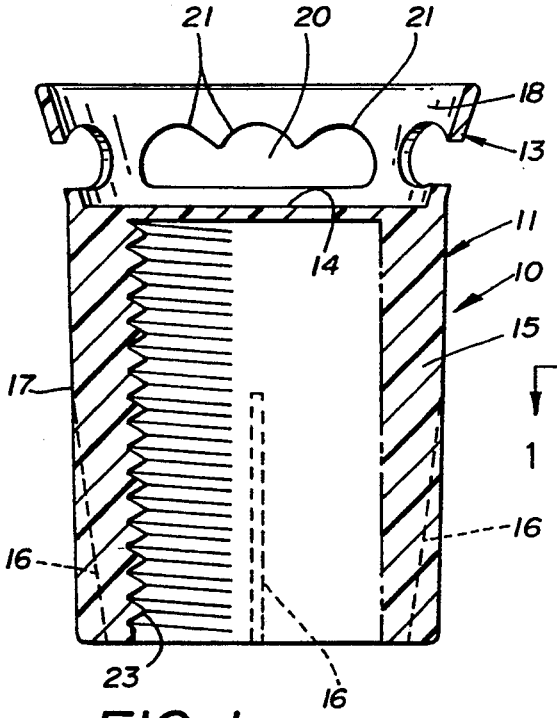
FIG. 1 is a cross-sectional view of the preferred embodiment of the invention.
Figure 2:
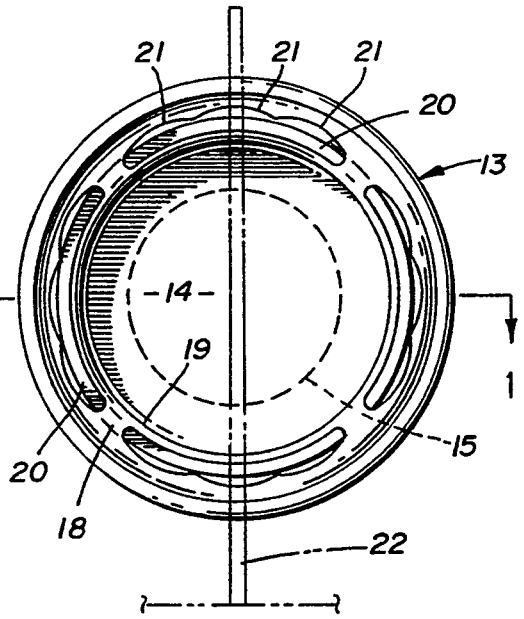
FIG. 2 is a top plan view of the preferred embodiment of the invention illustrated in FIG. 1.
Figure 7:
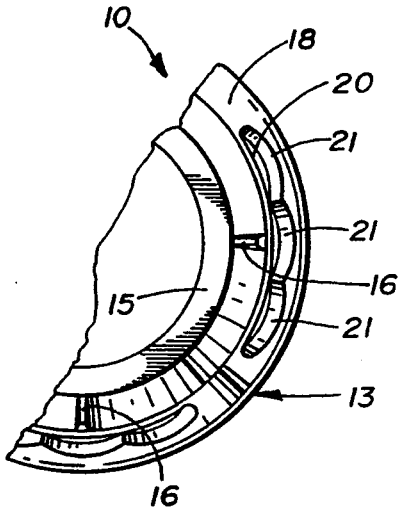
FIG. 7 is a partial bottom plan view of the preferred embodiment of the invention as illustrated in FIGS. 1-3.
Figure 3:
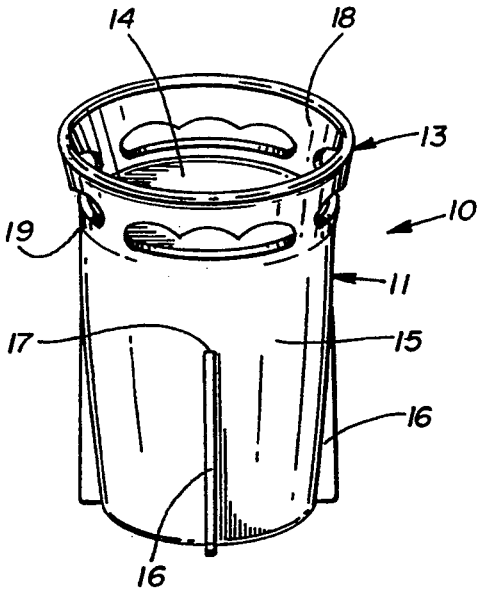
FIG. 3 is a perspective view of the preferred embodiment of the invention.

Referring to FIGS. 1-3 and 7 of the drawings, a preferred form of the invention can be seen defining a display cap 10 having a cap portion 11 and a display support portion 13. The cap portion 11 has a top portion 14 with a depending annular skirt 15 extending therefrom. The skirt 15 is tapered inwardly from the top portion 14 with a plurality of annularly spaced longitudinally tapered ribs 16 extending upwardly from the bottom edge of the skirt 16. Each of said tapered ribs 16 extends longitudinally in relation to the skirt 15 in spaced parallel relation to one another. The rib's taper is angularly inversed to that of said skirt taper as hereinbefore described so that each of said ribs 16 diminish in cross-sectional height as they advance upwardly along the skirt terminating midway up the skirt 15 at 17. The display support portion 13 defines an annularly upstanding angularly disposed flange 18 extending from and integral with a perimeter edge 19 of the top portion 14. The flange 18 extends angularly outwardly from the top perimeter edge 19 as hereinbefore described defining the display support portion 13.

The flange 18 has a plurality of oppositely disposed elongated apertures therein defining support engagement loops 20 each of which is generally rectangular with a series of arcuate interconnected notches 21 within.

It will be seen that due to the transverse alignment of the respective oppositely disposed support engagement loop 20 pairs that display support rods 22 (shown in broken lines in FIG. 2 of the drawing) for example can be interengaged therethrough supporting the cap portion 10 integrally extending therefrom. The cap portion 10 is shaped internally as shown in FIG. 1 to include a screw thread 23 configuration for cooperation with a like threaded container (not shown) as will be understood by those skilled in the art.

Figure 4:
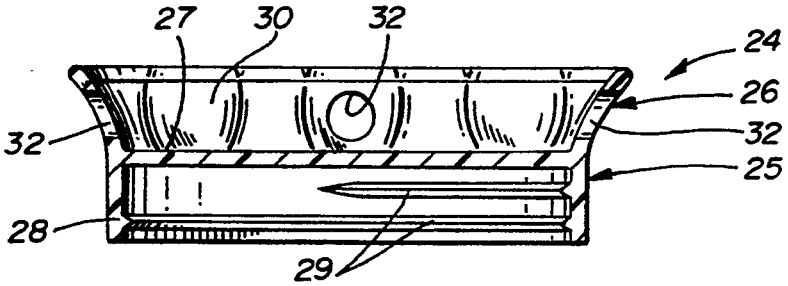
FIG. 4 is a cross-sectional view of a second embodiment on lines 4—4 of FIG. 5.
Figure 5:
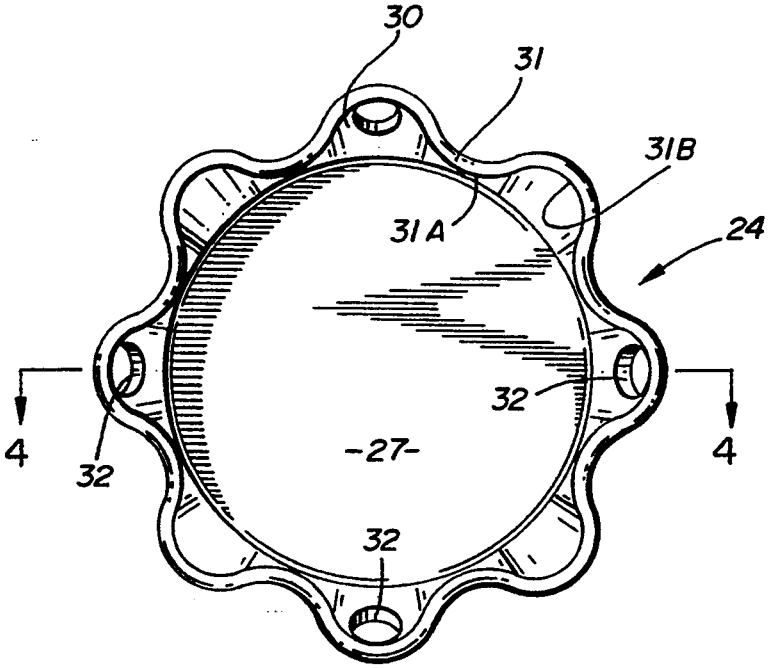
FIG. 5 is a top plan view of the second embodiment illustrated in FIG. 4.
Figure 6:
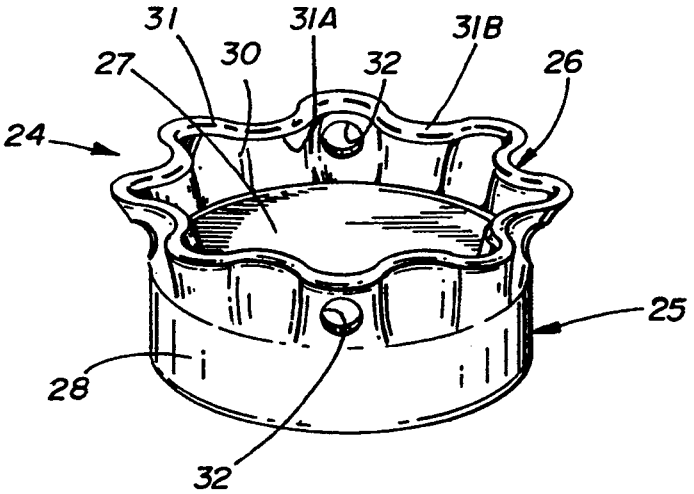
FIG. 6 is a perspective view of the second embodiment of the invention.

Referring now to FIGS. 4, 5 and 6 of the drawings, an alternate form of the invention can be seen wherein a secondary display screw cap 24 has a cap body 25 and a mounting portion 26. The cap body 25 has a cap top 27 with the mounting portion 26 extending integrally therefrom. The cap body 25 has an annularly disposed sidewall 28 which is threaded internally at 29 as will be well understood by those skilled in the art. The mounting portion 26 defines an upstanding angularly tapered annular flange 30 that is convoluted at 31 about its annular surface, as best seen in FIG. 5 of the drawings. The convoluted surface at 31 extends repeatedly in an arcuately inward fashion at 31A and an arcuately outwardly fashion at 31B along its annular path about the angularly tapered annular flange 30.

A plurality of oppositely disposed apertures 32 are formed within the angular tapered annular flange 30 at correspondingly aligned arcuately outwardly extending convolutions 31B in this alternate form chosen for illustration. The apertures 32 are circular in configuration and are arranged in aligned oppositely disposed pairs so as to receive the display support rod 22 therethrough.

By providing an integral display support portion the screw caps 10 and 24 effectively combine the multiple advantages of selective easy to open closure configurations with a display mounting configuration that will allow a variety of vertically suspended mounting of the configurations available and commonly found within the art.

Thus it will be seen that a new and novel display screw cap has been illustrated and described and it will be apparent to those skilled in the art that various changes and modifications may be made therein without departing from the spirit of the invention, therefore

We claim:

1. A display cap for containers to be positioned from a display surface comprising a cap portion and a display support portion, said cap portion having a top portion integral therewith and an annular skirt depending therefrom that is tapered longitudinally inwardly from said top portion along said annularly disposed skirt, the display support portion comprises an upstanding annular flange extending from said top portion with pairs of oppositely disposed apertures within said annular flange, each of said oppositely disposed apertures has arcuate interconnected arches extending downwardly therefrom and screw thread configurations within said cap portion.

2. The display cap for containers of claim 1 wherein said annular flange is angularly disposed outwardly from said cap portion.

3. The display cap for containers of claim 1 wherein said cap portion has multiple annularly spaced longitudinally extending ribs integral therewith.

4. The display cap of claim 3 wherein said ribs are tapered longitudinally along Maid cap portion defining spaced oppositely disposed pairs of said ribs terminating midway along said depending skirt.

5. A display cap for containers to be positioned from a display surface comprising a cap portion and a display support portion, said cap portion having a top portion integral therewith and an annular skirt depending therefrom that is tapered longitudinally inwardly from said top portion along said annularly disposed skirt, the display support portion comprises an upstanding annular flange extending from said top portion with pairs of oppositely disposed apertures within said annular flange, said annular flange is convoluted about its annular perimeter surface defining multiple annularly spaced arcuate inturned and arcuate outturned surfaces along an annular path defined by said annular flange, and screw thread configurations within said cap portions.

* * * * *